US005334077A

United States Patent [19]

Bailey

[11] Patent Number: 5,334,077

[45] Date of Patent: Aug. 2, 1994

[54] LIFT ASSEMBLY FOR LOWRIDER MODEL CARS

[76] Inventor: James E. Bailey, 2901 Ralph Bunch Dr., Leavenworth, Kans. 66048

[21] Appl. No.: 980,302

[22] Filed: Nov. 23, 1992

[51] Int. Cl.[5] ..... A63H 17/26

[52] U.S. Cl. ..... 446/466; 446/469; 446/23; 180/24.02; 280/43.23; 280/43.19

[58] Field of Search ..... 446/466, 469, 465, 462, 446/460, 23, 437; 180/24.02; 280/43.23, 43.22, 43.19, 704

[56] References Cited

U.S. PATENT DOCUMENTS

| | | | |
|---|---|---|---|
| 1,863,587 | 6/1932 | Arnold | 446/23 |
| 2,838,875 | 6/1958 | Hammond et al. | 446/466 |
| 3,102,734 | 9/1963 | Sittel | 280/43.19 |
| 4,696,655 | 9/1987 | D'Andrade et al. | 446/466 |
| 4,861,311 | 8/1989 | Alskog | 446/466 X |

FOREIGN PATENT DOCUMENTS

| | | | |
|---|---|---|---|
| 275823 | 12/1914 | Fed. Rep. of Germany | 446/437 |

*Primary Examiner*—Mickey Yu

*Attorney, Agent, or Firm*—Hovey, Williams, Timmons & Collins

[57] ABSTRACT

In a scale model of a lowrider vehicle including a chassis and first and second spaced axles supported on the chassis, a lift assembly includes the chassis being provided with guide structure for maintaining the transverse orientation of the first axle while allowing movement of the axle relative to the chassis within a plane perpendicular to the central longitudinal axis of the chassis. A lifting assembly is provided on the chassis for lifting the chassis relative to the axle between a lowered position and a raised position so as to simulate lifting and lowering movements of the modeled lowrider vehicle. In this manner, it is possible to simulate front and back, side-to-side and hopping moves conventionally performed with actual lowrider vehicles.

10 Claims, 2 Drawing Sheets

Fig.4.
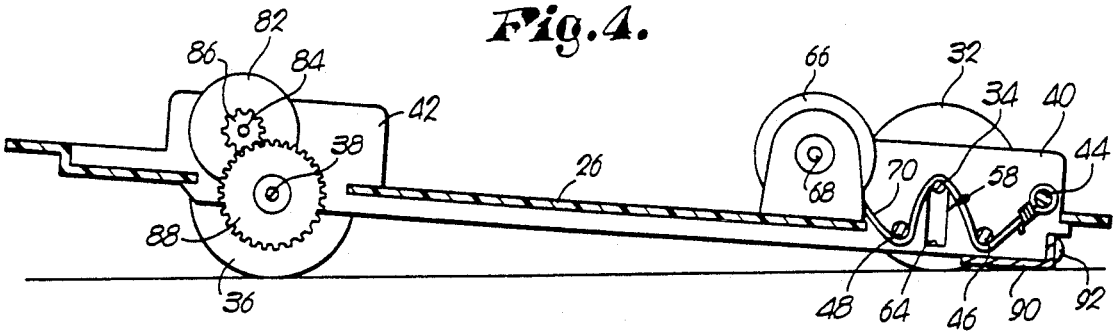
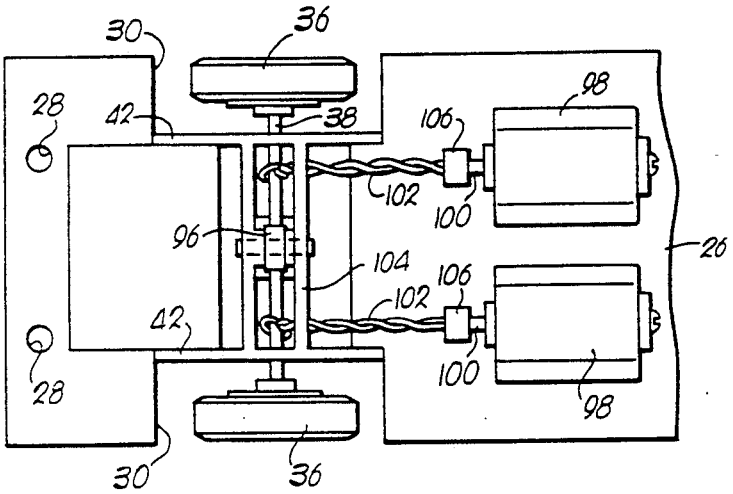
Fig.6.
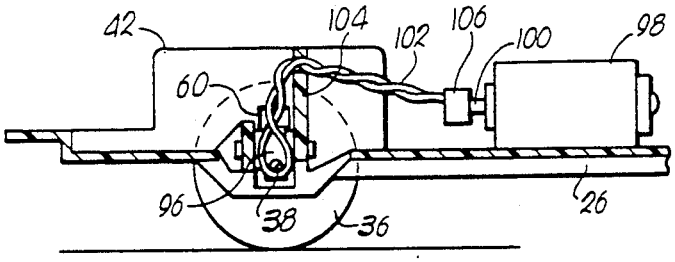
Fig.7.
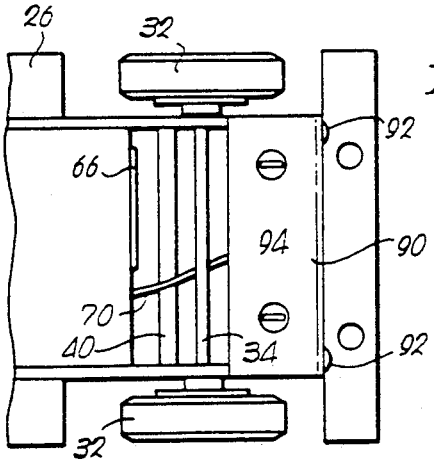
Fig.5.
Fig.8.
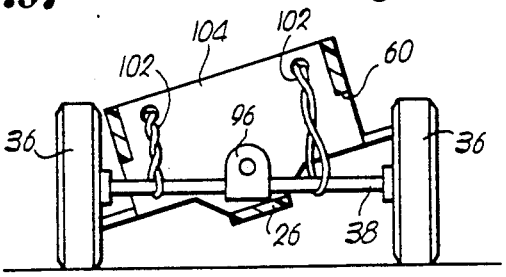

LIFT ASSEMBLY FOR LOWRIDER MODEL CARS

BACKGROUND OF THE INVENTION

1. Field of the Invention

The present invention relates generally to toys and, more particularly, to a scale model of a lowrider car or truck having a lift assembly for simulating the various hopping, rocking, rolling, lowering and lifting moves performed by actual lowriders.

2. Discussion of the Prior Art

One of the many ways in which cars and trucks are customized by individuals includes the installation of hydraulic lift assemblies within the suspension systems provided on the vehicles for permitting the operator to alter the orientation of the vehicle relative to the wheels.

Typically, the hydraulic set up in one of these "lowrider" vehicles includes a hydraulic suspension system, hydraulic pumps, dumps and a power source for creating the various desired movements. For example, depending upon the particular hydraulic arrangement employed, the chassis may be moved relative to any or all of the wheels such that either the front or rear end of the vehicle, or both, may be raised from or lowered to the ground, and hopping, side-to-side, and "dancing" movements may be performed.

Although it is known to construct scale models of lowrider vehicles and to customize these scale models by detailing them to appear similar to actual lowriders, these models fail to provide actual simulation of lowrider movements.

OBJECTS AND SUMMARY OF THE INVENTION

It is an object of the present invention to provide a scale model of a lowrider vehicle, wherein the model is capable of performing one or more of the various movements commonly attributed to actual lowriders.

It is another object of the invention to provide a lift assembly for use in a scale model of a lowrider vehicle for lifting the chassis of the model relative to at least one of the axles between a lowered position and a raised position in order to simulate lifting and lowering movements of the modeled vehicle.

In accordance with these and other objects, a model of a lowrider vehicle includes a chassis and first and second longitudinally spaced axles supported on the chassis and fitted with a pair of wheels on which the model is supported on the ground. The chassis includes a guide means for maintaining the transverse orientation of at least one of the axles while allowing movement of the axle relative to the chassis within a plane perpendicular to the central longitudinal axis of the chassis. A lifting means is provided for moving the chassis relative to the at least one axle between a lowered position and a raised position.

Preferably, the guide means includes a pair of laterally opposed side walls connected to the chassis, the side walls each being provided with a vertical slot through which the axle extends, the slots allowing rotation of the axle as well as vertical movement of the axle relative to the chassis within a plane perpendicular to the central longitudinal axis.

The lifting means preferably includes a motor mounted on the chassis and provided with a rotatable output shaft, a power supply, a circuit connecting the power supply with the motor, a switch for selectively closing the circuit to energize the motor, and a transmission means for converting the rotational movement of the motor into lifting movement for moving the chassis relative to the axle.

By constructing a scale model in accordance with the present invention, numerous advantages are realized. For example, by providing a model with a lift assembly it is possible to simulate the action as well as the appearance of a lowrider vehicle. Previously, it was only possible to reproduce the appearance of lowriders, and model builders were not able to simulate any movements other than a simple forward and reverse driving movement.

Another advantage obtained through the use of the present invention resides in the capability of simulating many different types of movements which are performed by actual lowrider vehicles. For example, with the inventive lift assembly, a model may be constructed to perform hopping, side-to-side and front and back movements, as well as conventional forward and reverse drive.

BRIEF DESCRIPTION OF THE DRAWING FIGURES

A preferred embodiment of the present invention is described in detail below with reference to the attached drawing figures, wherein:

FIG. 4 is a side elevational view, taken in section, of a car assembled in accordance with a second possible construction, illustrating a front end lift assembly and a rear end drive assembly;

FIG. 5 is a fragmentary bottom plan view of the front end of the car shown in FIG. 4, illustrating a spark generator supported on the car;

FIG. 6 is a fragmentary top plan view of the rear end of a car assembled in accordance with a third possible construction, illustrating a lift assembly for rocking the chassis back and forth about the longitudinal axis thereof relative to the rear axle of the car;

FIG. 7 is a fragmentary side elevational view of the car shown in FIG. 6; and FIG. 8 is a rear elevational view, taken in section, of the car illustrated in FIG. 6, showing the chassis in a rolled position relative to the rear axle.

DETAILED DESCRIPTION OF THE PREFERRED EMBODIMENT

Figure 1:
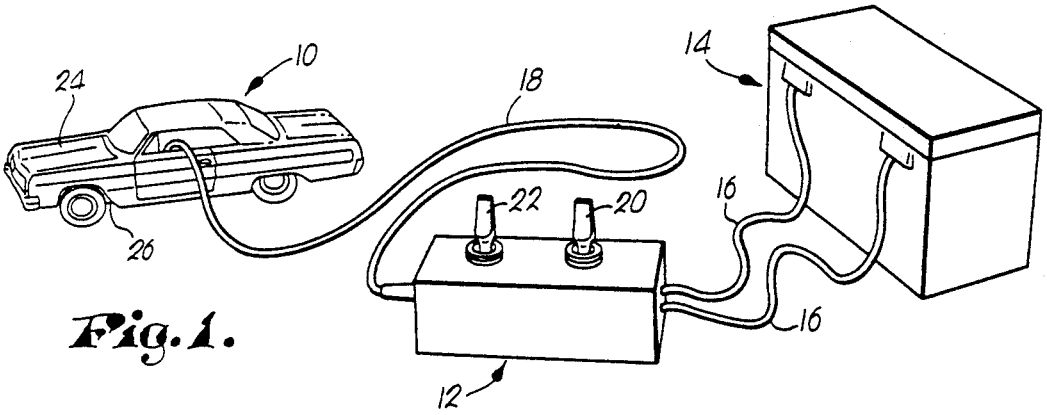
FIG. 1 is a perspective view of a scale model of a lowrider car, illustrating the car, a control box, and a power supply constructed in accordance with the preferred embodiment.

A scale model of a lowrider car constructed in accordance with a preferred embodiment of the invention is illustrated in FIG. 1. The model includes a car 10, a control box 12, a power source 14, and suitable wiring 16, 18 connecting the power source to the car via the control box.

The power source 14 may be either AC or DC, and preferably includes a 3.5-12 volt DC battery. The power source includes two terminals, each of which is connected by the wiring 16 to the control box. If desired, the wires may either be enclosed individually within an insulative sleeve, or may be grouped together as a pair of insulated wires which are, in turn, enclosed within a single insulative sleeve.

A pair of three position switches 20, 22 are provided on the control box 12 and connect the power supply to the car in a manner described more fully below, in such a way that each switch is movable from a central "off" position to either of two opposed "on" positions. Preferably, each switch is biased toward the "off" position by a spring or other suitable biasing mechanism so that when an operator removes pressure from the switch it returns to the "off" position.

Figure 2:
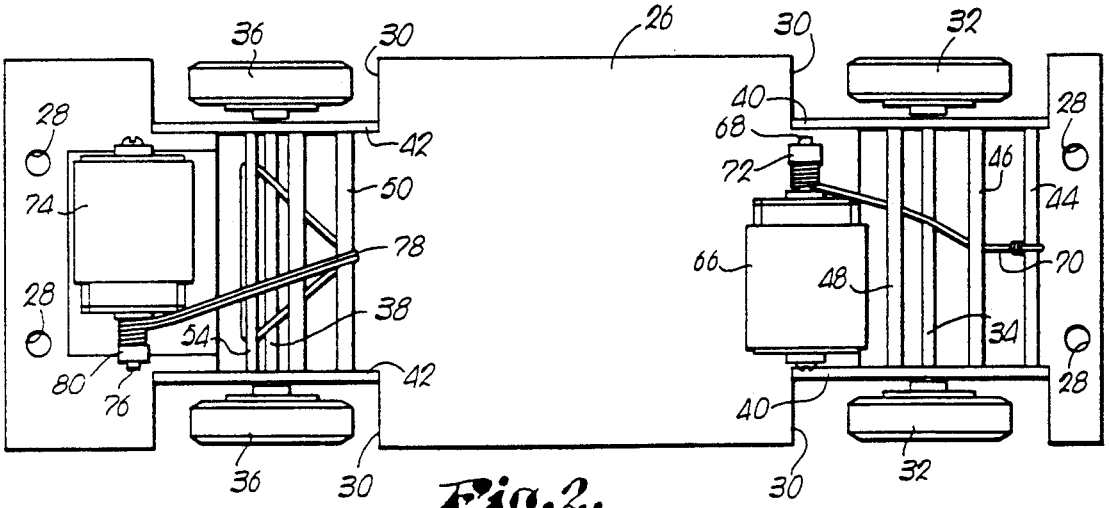
FIG. 2 is a top plan view of the car, with the body removed, illustrating the construction of preferred front and rear end lift assemblies.

The car 10 includes a body 24 that is removably supported on a chassis 26, shown in FIG. 2, by a plurality of threaded fasteners secured through holes 28 in the chassis. The body of the car has been removed in FIG. 2, to illustrate the construction of the chassis 26, which is of a generally flat rectangular shape having four notches 30 cut into the circumference thereof for receiving front wheels 32 supported on an axle 34, and rear wheels 36 supported on an axle 38.

Figure 3:
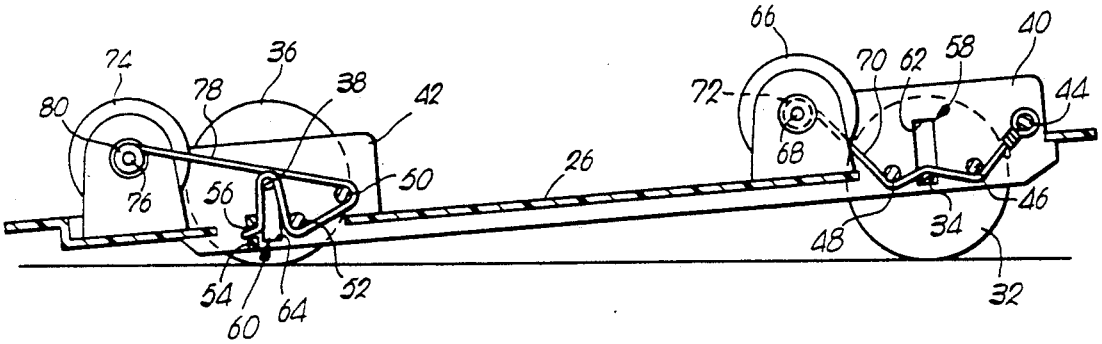
FIG. 3 is a side elevational view, taken in section, of the car shown in FIG. 2, illustrating the rear end of the chassis in a lowered position and the front end of the chassis in a raised position.

Front and rear side walls 40, 42 are attached to and extend vertically upward from the chassis adjacent the inner longitudinal edges of the notches 30. Three cross members 44, 46, 48 extend between the two opposed front side walls 40, and an additional three cross members 50, 52, 54 extend between the two opposed rear side walls 42. Preferably, as shown in FIG. 3, the cross members 44, 46, 48, 50, 52 are cylindrically shaped for reasons discussed more fully below, while the cross member 54 is flat, having a pair of spaced openings 56 extending therethrough in a direction substantially parallel to the longitudinal axis of the chassis.

Returning to FIG. 2, the front and rear axles 34, 38 extend in a direction transverse to the central longitudinal axis of the chassis 26 at the front and rear ends of the chassis such that the car moves longitudinally forward and backward upon rolling movement of the wheels. As shown in FIG. 3, guide means are provided for maintaining the transverse orientation of the axles while allowing relative movement between the chassis and the axles. Specifically, the guide means allows each axle 34, 38 to move relative to the chassis within a plane perpendicular to the central longitudinal axis of the chassis.

Preferably, the guide means includes a pair of opposed vertical slots 58 formed in each of the front end side walls 40, and a pair of opposed vertical slots 60 formed in each of the rear end side walls 42. Each pair of slots 58, 60 define vertical side surfaces which guide relative movement of the axles when the chassis is moved between lowered and raised positions. Further, each pair of slots 58 and 60 include upper end walls 62 which limit downward movement of the chassis relative to the axles 34, 38, and lower end walls 64 which limit upward movement of the chassis relative to the axles.

A separate lifting means is provided on the chassis for moving the chassis relative to each of the axles. Preferably, the front end lifting means includes a motor 66 mounted on the chassis and provided with an output shaft 68, the power supply 14, a circuit connecting the power supply with the motor, a switch 20 for opening and closing the circuit, and a transmission means for converting the rotational movement of the output shaft 68 into lifting movement for moving the chassis relative to the front axle 34.

The motor 68 may be either an AC or DC driven motor, and preferably is a small DC motor of a size capable of being supported within the body of the scale model. The output shaft 68 rotates when the motor is energized, and the motor is oriented on the chassis with the output shaft extending in a direction substantially perpendicular to the central longitudinal axis of the chassis.

The circuit connecting the power supply 14 with the motor 66 includes the switch 20, which is movable between the "off" position, a first "on" position in which the polarity of the battery is connected with the motor in a first direction such that the output shaft 68 rotates in one rotational direction, and a second "on" position in which the polarity of the battery is reversed such that the output shaft rotates in the opposite rotational direction.

The transmission means employed in the front end lifting means includes an elongated, flexible, pliant filament 70 which includes a first end tied to the forwardmost cross member 44, and a rear end retained on the output shaft of the motor 66 by a retainer 72. Preferably, the retainer is a small plastic annular ring which fits onto the output shaft and engages the shaft through a friction-fit while trapping the filament between the shaft and the ring. The filament extends beneath the intermediate cross member 46, over the front axle 34, and beneath the rearmost cross member 48 so that tensioning of the filament causes the chassis 26 to be lifted on the front axle while loosening of the filament permits the chassis to drop under the force of gravity.

By arranging the rearmost and intermediate cross members 48, 46 at a height such that the lower edges of the cross members are at the same height as the lower end walls 64 of the slots 58, it is possible to control movement of the axle throughout the entire height of the slots by controlling the amount of tension exerted on the filament 70.

When the model is at rest in the lowered position, as shown in FIG. 4, the filament 70 is unwrapped from the output shaft 68 of the motor such that no tension is applied to the filament. During operation of the front end lifting means, the switch 20 is moved to either of the "on" positions causing the output shaft to rotate. During this rotation of the shaft, the retainer 72 holds the end of the filament 70 in place causing the filament to be wrapped onto the shaft, thus tensioning the filament. Because the filament passes over the front axle and beneath both cross members 46, 48, as shown in FIG. 3, tensioning of the filament lifts the chassis upward relative to the axle toward an uppermost position as illustrated in FIG. 3.

At any time during lifting of the chassis, if the switch 20 is released, it will return to the "off" position and the position of the chassis 26 relative to the axle 34 will be maintained. Thereafter, if additional lifting of the front end is desired, the switch 20 is returned to the same "on" position until the chassis reaches the desired height or until the axle abuts against the lower end walls 64 of the slots 58. Alternately, if the operator desires to lower the front end of the chassis, the switch 20 may be moved to the other "on" position reversing the polarity of the power source such that the output shaft 68 is rotated in a direction in which the filament unwinds from the shaft, releasing tension of the filament and lowering the chassis.

In order to perform a hopping movement with the model, the switch 20 is moved to one of the "on" positions, and is held while the motor 66 pulls the axle 34 along the entire length of the slots 58 into contact with the lower end walls. This rapid lifting movement of the chassis is carried out quickly enough to cause the chassis to pull the front wheels 32 of the model completely off the ground. The height to which the front end hops is determined by the power of the motor selected.

Once the axle 34 has been moved completely against the lower end walls 64 of the slots 58, the switch is released and returns to the "off" position. As the model is forced back toward the ground by gravity, and the wheels re-engage the ground. The downward momentum of the model forces the axle upward in the slots with a force sufficient to overcome the retaining force exerted on the end of the filament by the motor such that the filament unwraps, allowing the chassis to move completely to the lowered position. Thereafter, the switch may be moved again to one of the "on" positions to repeat the hopping movement.

Returning to FIG. 2, the rear end lifting means also includes a motor 74 mounted on the chassis and provided with an output shaft 76, the power supply 14, a circuit connecting the power supply with the motor, the other switch 22 of the control box 12, and a transmission means for converting the rotational movement of the output shaft into lifting movement for moving the chassis relative to the rear axle 38.

The motor 74 is similar to the motor 66, and is also oriented on the chassis with the output shaft extending in a direction substantially perpendicular to the central longitudinal axis of the chassis.

The circuit connecting the power supply with the motor includes the switch 22, which is movable between the "off" position, a first "on" position in which the polarity of the battery is connected with the motor in a first direction such that the output shaft rotates in one rotational direction, and a second "on" position in which the polarity of the battery is reversed such that the output shaft rotates in the opposite rotational direction.

Preferably, the switch 22 is spring biased toward the "off" position so that when an operator releases the switch, the circuit is opened and the motor is de-energized. The circuit connecting the motor with the battery is preferably independent of the circuit providing power to the front end motor.

The transmission means employed in the rear end lifting means includes an elongated, flexible, pliant filament 78 which includes first and second ends tied to the output shaft by a retainer 80. As shown in FIG. 3, the filament extends over the forwardmost cross member 50, beneath the intermediate cross member 52, over the rear axle 38, is threaded through one of the openings 56 in the rearmost cross member 54, and is then doubled back through the other opening in the member 54 and along this same path to the motor 74.

This construction of the transmission means represents an alternative arrangement to that shown in connection with the front end lift assembly, and either arrangement may be used without departing from the scope of the present invention.

By threading the filament 78 through the arrangement of cross members 50, 52, 54 in this manner, the filament is tensioned when the motor is energized, and the chassis is lifted on the rear axle 38. Likewise, by reversing the direction of the motor 74, the filament is loosened, permitting the chassis to drop under the force of gravity relative to the axle. Thus, operation of the rear end lift assembly is identical to operation of the front end assembly, except that the switch 22 is used instead of switch 20.

An alternate construction of the rear end of the lowrider model car of the present invention is illustrated in FIG. 4. In this construction, the slots 60 provided in the rear end of the chassis 26 are replaced by circular openings through which the rear axle 38 extends such that only rotational movement of the axle, as well as some longitudinal movement thereof, is permitted. A drive means is provided for rotating the rear axle 38 in either the forward or reverse direction so as to propel the car along the ground.

This drive means preferably includes a motor 82 mounted on the chassis 26 and provided with an output shaft 84, the power supply 14, a circuit connecting the power supply with the motor, the switch 22 for selectively closing the circuit to energize the motor, and a means for transmitting rotation of the output shaft to the rear axle 38.

The motor 82 is similar to the motors 66, 74 discussed above, and is provided with a small drive pinion 86 which is secured to the output shaft for rotation therewith. The power supply 14 is the same power supply discussed above, and the circuit connecting the power supply with the motor 82 is identical to the circuit of the rear end lift assembly.

The means for transmitting rotation of the output shaft 84 to the rear axle 38 includes the small drive pinion 86 provided on the output shaft, and a large driven pinion 88 that is fixed to the rear axle of the car. When the switch 22 is moved from the "off" position to one of the "on" positions, the motor 82 rotates the output shaft 84 in the counterclockwise direction, and this rotation is transmitted through the pinions 86, 88 to the rear axle such that the car rolls forward. Movement in the reverse direction is carried out by moving the switch 22 to the other "on" position such that the motor rotates the output shaft in the clockwise direction.

If desired, it is possible to provide a spark generating means supported on the chassis for generating sparks when the car is propelled along the ground. Preferably, the spark generating means includes a skid plate 90 which may be fastened to the front end of the chassis at a position in which the skid plate may be brought into contact with the ground when the front end of the chassis is lowered relative to the front axle.

As illustrated in FIG. 5, the skid plate 90 may include a transverse, L-shaped plate secured to the chassis by a pair of threaded fasteners 92. Additional threaded elements 94, such as small round-headed screws may be attached to the bottom surface of the skid plate in order to present wear surfaces which create sparks during frictional contact with the ground. By providing these additional wear surfaces, once abrasion of the wear surfaces has occurred, the screws may simply be replaced with new screws. Otherwise, the skid plate itself wears during frictional contact with the ground and must be replaced upon failure.

Another alternate construction of the rear end of the lowrider model car is illustrated in FIGS. 6–8, wherein the rear end lift assembly has been replaced by a modified lift assembly. Turning first to FIG. 7, according to this construction, the chassis 26 is again provided with slots 60 within which the rear axle 38 is received such that the rear axle is freely movable relative to the chassis within a plane perpendicular to the central longitudinal axis of the chassis. If desired, as shown in FIG. 8, a block 96 may be supported on the axle for permitting attachment of the axle to a central pivot axis.

As illustrated in FIG. 6, the lifting means includes two motors 98 mounted on the chassis forward of the rear axle, the power supply 14, a circuit connecting each of the motors to the power supply, a switch for each of the circuits, and transmission means in association with each of the motors for converting the rotational output of each of the motors 98 into lifting movement for rocking the chassis back and forth about the pivot axis of the block 96.

Preferably, the two motors 98 are similar to the motors 66, 74, 82 discussed previously, and are provided with output shafts 100 which are rotated when the motors are energized. The circuit including each of the motors is identical to the circuits discussed above, and a separate switch is provided for each circuit so that either of the motors may be energized for rotation in either direction. Thus, if this rear end lift assembly is employed together with the front end lift assembly, the control box is provided with three switches, one for each of the motors.

The transmission means employed with the motors 98 includes elongated, flexible, pliant filaments 102 which are looped around the rear axle 38 adjacent each axial end thereof, as shown in FIG. 7, and which are passed through holes in a cross member 104 extending between the side walls 42 of the chassis. Each filament includes first and second ends tied to the output shafts 100 by a retainer 106.

Upon energization of one of the motors 98, the filament attached thereto is twisted onto itself such that the length of the twisting filament is shortened and upward tension is exerted on the associated end of the axle, as shown in FIG. 8. Thus, the chassis is pulled downward in a rocking or banking movement which simulates a similar movement performed by actual lowrider vehicles.

At the time of energization of one of the motors 98, when the chassis is rocked toward one end of the axle, the filament of the other motor is forced toward an untwisted position, and obtains this position by actually turning the output shaft of the associated motor or by overcoming the holding force of the retainer. Alternately, it is possible to energize both motors 98 simultaneously in opposite rotational directions so that the filaments are positively driven toward the desired twisted or untwisted positions in order to carry out the rocking movement.

Although the invention has been described with reference to the preferred embodiment illustrated in the attached drawing figures, it is noted that substitutions may be made and equivalents employed herein without departing from the scope of the invention as recited in the claims.

What is claimed is:

1. A scale model of a lowrider vehicle, the model comprising:

a chassis defining a central longitudinal axis;

first and second longitudinally spaced axles supported on the chassis, each extending in a direction transverse to the central longitudinal axis and including a pair of wheels on which the model is supported on the ground, the chassis including a guide means for maintaining the transverse orientation of the first axle while allowing movement of the first axle relative to the chassis within a plane perpendicular to the central longitudinal axis, the guide means including a pair of laterally opposed side walls connected to the chassis, the side walls each being provided with a vertical slot through which the first axle extends, the slots allowing rotation of the first axle as well as vertical movement of the first axle relative to the chassis within a plane perpendicular to the central longitudinal axis; and a lifting means for moving the chassis relative to the first axle between a lowered position and a raised position, the lifting means including a motor mounted on the chassis and provided with a rotatable output shaft, a power supply, a circuit connecting the power supply with the motor, a switch for selectively closing the circuit to energize the motor, and a transmission means for converting the rotational movement of the output shaft into lifting movement for moving the chassis relative to the first axle.

2. A scale model as recited in claim 1, wherein the chassis includes a guide means for each axle, the scale model further comprising separate lifting means in association with each axle for moving the chassis relative to the axles between a lowered position and a raised position.

3. A scale model as recited in claim 1, wherein the guide means and lifting means are associated with only the first axle, the scale model further comprising a drive means for rotating the second axle to propel the apparatus along the ground.

4. A scale model as recited in claim 3, wherein the drive means includes a motor mounted on the chassis and provided with a rotatable output shaft, and a means for transmitting rotation of the output shaft to the second axle.

5. A scale model as recited in claim 3, further comprising a spark generating means supported on the chassis for generating sparks when the apparatus is propelled along the ground.

6. A scale model as recited in claim 1, wherein the chassis includes a structural element positioned beneath the motor and between the motor and the first axle, the transmission means including a filament including a first end connected to the output shaft of the motor, the filament extending beneath the structural element of the chassis and engaging the first axle so that during rotation of the output shaft, the filament is wound onto the output shaft and pulls the first axle toward the structural element thus moving the chassis to the raised position.

7. A scale model as recited in claim 6, wherein the filament includes a second end secured to the chassis at a location positioned opposite the first axle from the structural element at a height equal to the height of the structural element.

8. A scale model of a lowrider vehicle, the model comprising:

a chassis defining a central longitudinal axis;

first and second longitudinally spaced axles supported on the chassis, each extending in a direction transverse to the central longitudinal axis and including a pair of wheels on which the model is supported on the ground, the chassis including a guide means for maintaining the transverse orientation of the first axle while allowing movement of the first axle relative to the chassis within a plane perpendicular to the central longitudinal axis, the guide means including a mounting block supported on the chassis for movement about a pivot axis extending in a direction parallel to the central longitudinal axis, the axle being supported on the mounting block and including opposed axial ends located on opposite sides of the mounting block so that when the mounting block is pivoted, the first axle turns about the pivot axis within a plane perpendicular to the central longitudinal axis; and a lifting means for moving the chassis relative to the first axle between a lowered position and a raised position, the lifting means moving the chassis relative to the first axle between a lowered position in which the chassis is level with the first axle and a raised position in which the chassis is banked relative to the first axle, the lifting means including a motor mounted on the chassis and provided with a rotatable output shaft, a power supply, a circuit connecting the power supply with the motor, a switch for selectively closing the circuit to energize the motor, and a transmission means for converting the rotational movement of the motor into lifting movement for moving the chassis relative to the first axle toward the banked position.

9. A scale model as recited in claim 8, wherein the chassis includes a structural element positioned beneath the motor and between the motor and the first axle, the transmission means including a filament including a pair of opposed ends both connected to the output shaft of the motor, the filament extending over the structural element of the chassis and around the first axle adjacent one end of the first axle so that during rotation of the output shaft, the filament is twisted and pulls the chassis down toward the one end of the first axle thus moving the chassis to the banked position.

10. A scale model as recited in claim 9, wherein:

the chassis defines opposed, laterally spaced first and second sides; and the lifting means includes a pair of motors mounted on the chassis and provided with rotatable output shafts, and a transmission means for converting the rotational movement of each motor into lifting movement for moving the chassis relative to the first axle toward a banked position, wherein energization of one motor moves the chassis toward a first banked position in which the first side of the chassis is raised relative to the second side, and energization of the other motor moves the chassis toward a second banked position in which the second side of the chassis is raised relative to the first side.

* * * * *